United States Patent [19]

Manthiram

[11] 4,029,192

[45] June 14, 1977

[54] DIGITAL CIRCUIT FOR CONTROLLING THE RETURN SPEED OF A BUSINESS MACHINE CARRIAGE

[75] Inventor: Chockalingam Manthiram, Plymouth, Mich.

[73] Assignee: Burroughs Corporation, Detroit, Mich.

[22] Filed: Feb. 27, 1975

[21] Appl. No.: 553,536

[52] U.S. Cl. ..... 197/19; 197/1 R; 197/68; 197/187; 318/313

[51] Int. Cl.[2] ..... B41J 5/30

[58] Field of Search ..... 197/1 R, 68, 65, 66, 197/60, 19, 82, 93, 183, 187; 318/313, 685, 696, 327

[56] References Cited

UNITED STATES PATENTS

| | | | |
|---|---|---|---|
| 3,292,530 | 12/1966 | Martin | 197/65 X |
| 3,578,129 | 5/1971 | Kato et al. | 197/187 X |
| 3,582,699 | 6/1971 | Badessa et al. | 318/327 |
| 3,670,861 | 6/1972 | Zenner et al. | 197/68 X |
| 3,703,949 | 11/1972 | Howard et al. | 197/1 R |
| 3,752,288 | 8/1973 | Detig et al. | 197/1 R |
| 3,834,505 | 9/1974 | Fowler et al. | 197/66 X |
| 3,882,988 | 5/1975 | Sloan et al. | 197/66 |
| 3,898,545 | 8/1975 | Loppa et al. | 318/313 |

*Primary Examiner*—Ralph T. Rader
*Attorney, Agent, or Firm*—David R. Syrowik; G. Gregory Schivley; Carl Fissell, Jr.

[57] ABSTRACT

A digital electrical circuit for selectively activating a clutch mechanism for controlling the return speed of a business machine carriage. A carriage speed pulse transducer provides a series of sync pulses with intervals between each sync pulse being a function of the return speed of the carriage. These sync pulses and a carriage return command pulse are gated into control circuitry. The control circuitry provides a continuous pulse when the interval of the sync pulses signals that the carriage has exceeded a desired speed. The continuous pulse is used to activate the clutch mechanism for reducing the return speed of the carriage.

10 Claims, 4 Drawing Figures

DIGITAL CIRCUIT FOR CONTROLLING THE RETURN SPEED OF A BUSINESS MACHINE CARRIAGE

BACKGROUND OF THE INVENTION

This invention relates to carriage returns for business machines. More particularly, it involves a digital circuit for selectively activating a clutch mechanism for controlling the return speed of a business machine carriage.

Various mechanisms have been employed to return the print carrier or carriage to its home position after it has finished writing on one line of a paper, card or other media. One widely used mechanism is a spring. Briefly, one end of the spring is attached to the frame of the business machine while the other end is attached to the carriage. As the carriage progresses away from its home position, it stretches the spring. When the carriage is released, the spring collapses and returns the carriage again to its home position. This spring biased carriage return mechanism is desirable because of its simplicity. However, it has its disadvantages, especially in business machines which require accurate positioning of characters on the paper or other media. The spring tends to return the carriage with such force as to slam it against the frame of the business machine. Not only does this create undesirable noise, it causes the machine to vibrate which in turn can deleteriously affect the positioning of the characters printed on the paper.

It has heretofore been suggested to reduce such noise, shock and vibration by means of various mechanical and electrical devices, or a combination of both. However, these devices have either proven to be too slow, too complex or too expensive and have not lent themselves to being readily incorporated into existing business machines.

OBJECT AND SUMMARY OF THE INVENTION

Therefore, it is the primary object of this invention to provide a relatively simple, yet effective digital circuit having fast response for controlling the return velocity of a business machine carriage.

Briefly, this invention provides a carriage speed pulse transducer which produces a series of sync pulses, with intervals between each pulse being a function of the return speed of the carriage. The sync pulses and a carriage return command pulse are gated to a digital electrical circuit for producing a continuous pulse when the interval of the sync pulses decreases below a preset value. In such manner, a continuous pulse is produced whenever the return speed of the carriage has exceeded a desired speed. The continuous pulse is preferably amplified through a driver and is coupled to an electromagnetic coil of a clutch mechanism. The coil is thus energized by the continuous pulse and activates the clutch mechanism to reduce the return speed of the carriage. When the speed of the carriage has been reduced, the continuous pulse is no longer produced because the interval between the sync pulses is above the preset value. This action is continued uniformly until the carriage has reached its home position.

DESCRIPTION OF THE PREFERRED EMBODIMENT

Figure 1:
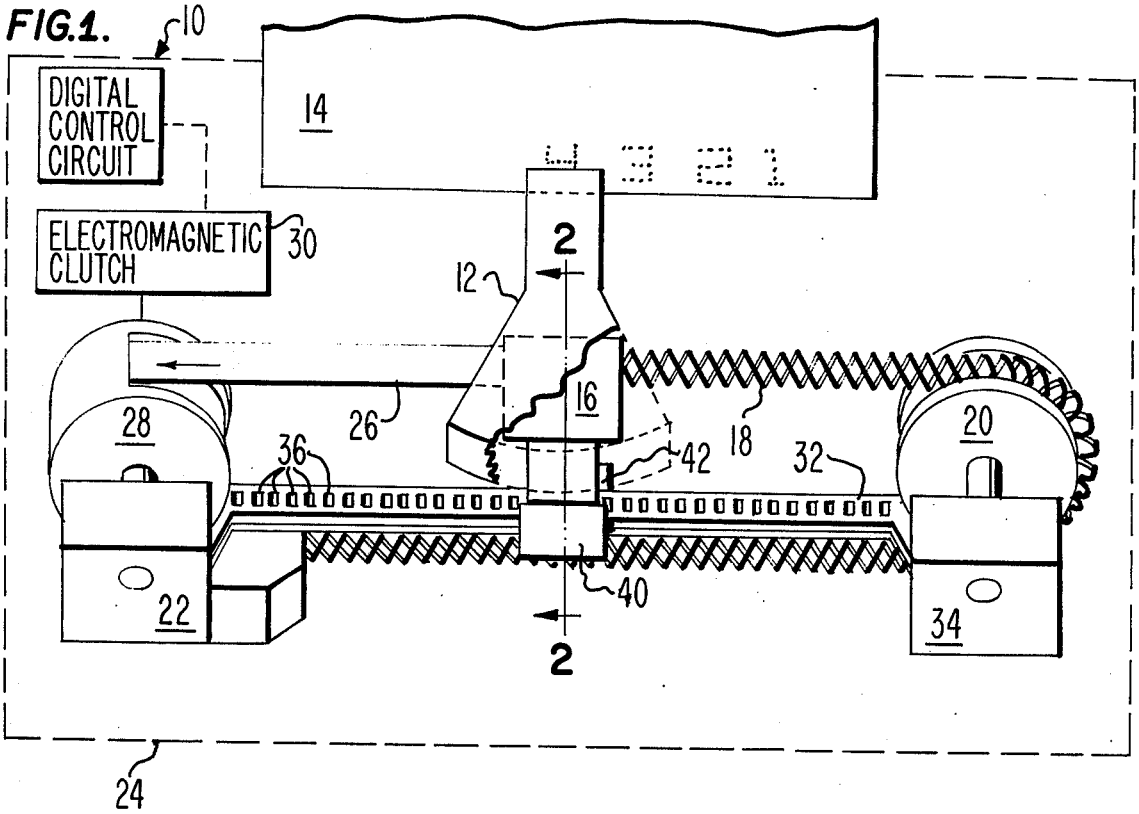
FIG. 1 is a diagrammatic view of a business machine in which the carriage is spring biased with regards to its home position.

Referring to FIG. 1, there is shown a simplified diagrammatic view of an example of a business machine 10 which may be used with the digital control circuit of this invention. One example of business machine 10 is the Victor IMP 130 Pin Printer marketed by Victor Corporation. Business machine 10 includes a print carrier or carriage 12 having a plurality of wire printers therein. The wire printers are selectively activated by solenoids to print characters on a readable medium such as paper 14. The underside of carriage 12 is mounted on a support bracket 16. A spring 18 is connected to one side of the bracket 16 and is wound around a pulley 20. The other end of the spring 18 is attached to a post 22 which is securely fastened to the frame 24 for business machine 10. In such manner, carriage 12 is spring biased with respect to its home position. That is, as the carriage 12 progresses away from the rightmost portion of paper 14, the spring 18 stretches to provide a rightwardly force on the carriage 12.

In order to urge the carriage from its home position so that it may print a complete line on the paper 14, the left side of the bracket 16 is attached to a drive mechanism. The drive mechanism includes a non-resilient tape 26 which is wound around a drive disk 28. As the drive disk 28 is rotated counterclockwise, it winds the tape 26 around it and thereby pulls carriage 12 leftwardly along the line of the paper to be printed. The speed and timing of the movement of carriage 12 during this print operation is accomplished by mechanisms known in the art. The drive disk 28 can, for example, be selectively engaged by an electromagnetic clutch 30 to rotate drive disk 28 counterclockwise as desired. Upon completing the print operation for a particular line, the clutch 30 can be disengaged from drive disk 28 and the carriage 12 will be returned to its home position by the spring 18.

Figure 2:
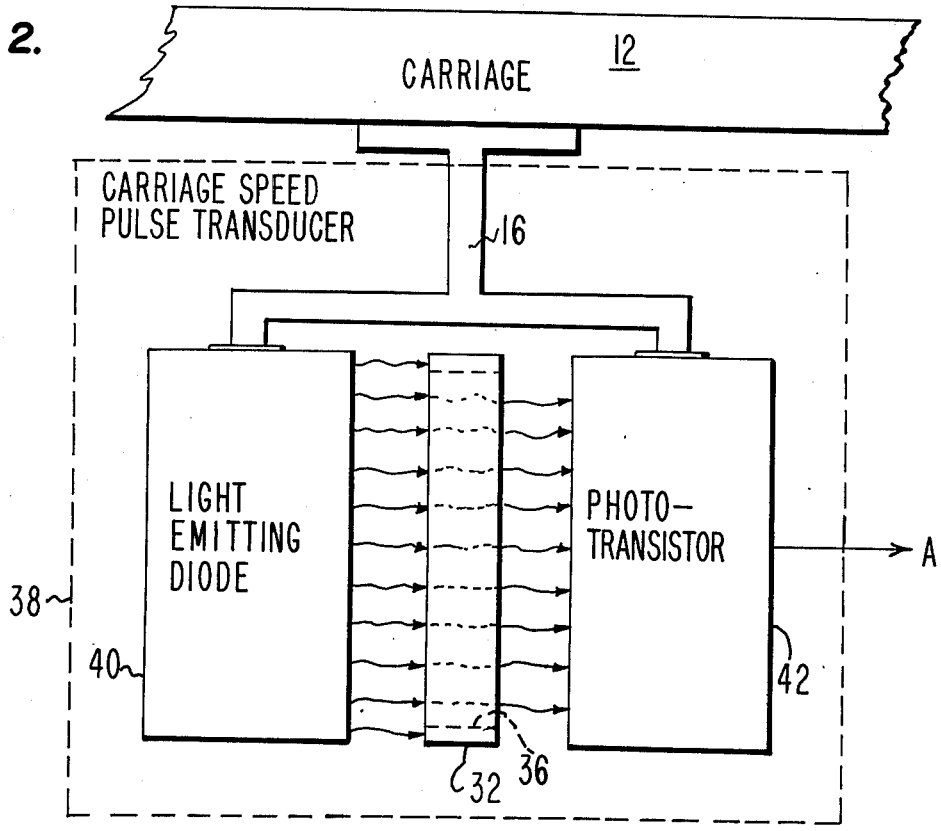
FIG. 2 is a diagrammatic view along the lines 2—2 of FIG. 1 showing a carriage speed pulse transducer as embodied in this invention.

Business machine 10 also includes a vertically oriented optical strobe grid 32 which is stationarily fastened between post 22 and a similar post 34. Grid 32 is positioned directly underneath bracket 16 and is parallel to the line of motion of carriage 12 during its printing operation. Grid 32 includes a plurality of equally spaced slits 36 running transversely to the longitudinal axis of grid 32. As can be seen most clearly in FIG. 2, bracket 16 carries a carriage speed pulse transducer 38. Transducer 38 includes a light source such as a light emitting diode 40 disposed on one side of the grid, and a light responsive photoelectrical device such as phototransistor 42 disposed on the other side of the grid. Diode 40 shines light through grid 32 towards a receptive surface of phototransistor 42. As carriage 12 moves along grid 32, light from diode 40 will strike phototransistor 42 when it is aligned with one of the slits 36 in the grid 32. In such manner, phototransistor 42 produces an output electrical signal in the form of a series of very short width pulses, or sync pulses, having an interval between each pulse that is an inverse function of the speed of carriage 12. That is, the interval between succeeding sync pulses decreases with increasing speed of carriage 12 whether during its forward printing operation or when the carriage 12 is returned to its home position via spring 18.

Figure 3:
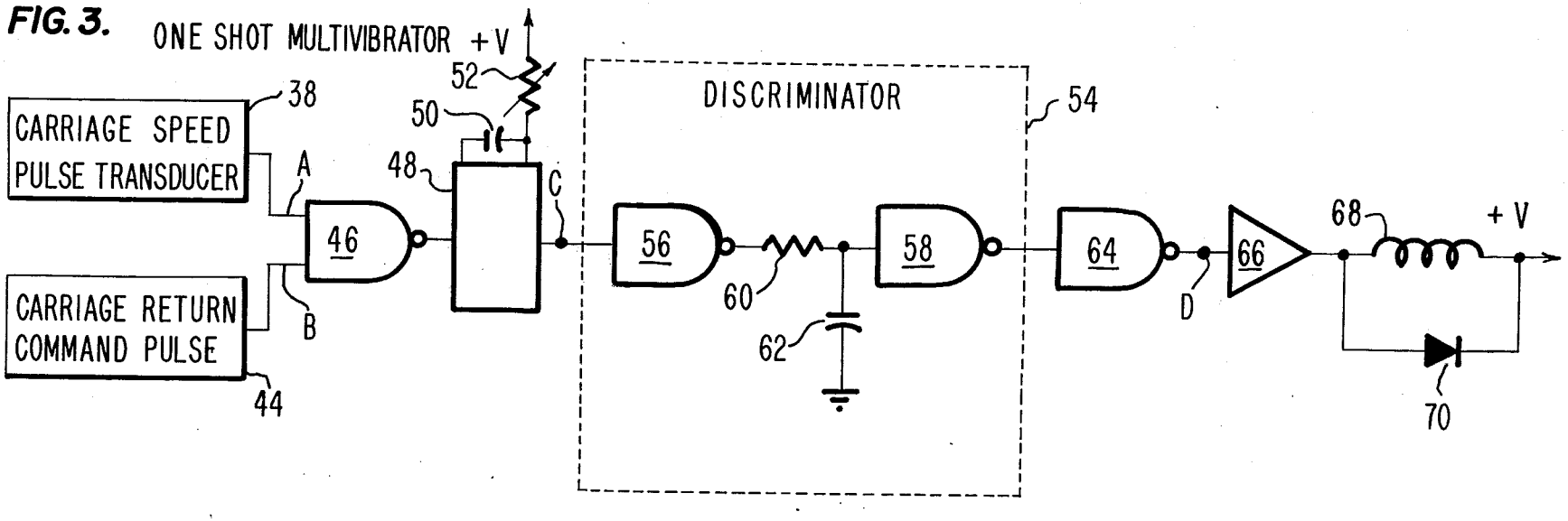
FIG. 3 is a schematic view of a digital circuit for controlling the speed of the carriage as it is returned to its home position by the spring.

As mentioned in the background of this invention, it is undesirable to allow the carriage 12 to return freely to its home position by the force of spring 18. The uncontrolled speed of return of carriage 12 results in undesirable noise, vibration, and may even result in breakage. Accordingly, the digital control circuit as shown in FIG. 3 is employed to selectively activate the coil of clutch 30 and use it as a brake to impede the uncontrolled return speed of carriage 12. The output of carriage speed pulse transducer 38 and a carriage return command pulse 44 are gated into a NAND gate 46. Carriage return command pulse 44 is produced at the end of the printing operation by electrical devices coupled to a mechanism (not shown) in business machine 10 which release carriage 12 to return it to its home position via spring 18. When the carriage 12 is released, the electrical devices produce a constant voltage output, or high, as shown in B of FIG. 4. When carriage 12 returns to its home position, the command pulse returns to a zero, or low, value.

The output of NAND gate 46 is connected to a one-shot multivibrator 48. Multivibrator 48 can be an off the shelf item such as TT$\mu$L 9601 or the like. Multivibrator 48 includes a feedback capacitor 50 and a variable resistor 52 coupled between capacitor 50 and a voltage source. The RC time constant of this network determines the preset value of the multivibrator 48. For purposes of this invention, the preset value of one-shot multivibrator 48 is the time during which the multivibrator will produce an output pulse without requiring another triggering input pulse. The width of the multivibrator output pulse in response to only one trigger pulse will be referred to as its preset width. It should be noted, however, that the multivibrator 48 will produce output pulses of varying widths depending upon the interval between successive trigger pulses. If the time interval between the trigger pulses is greater than the preset value, the multivibrator will produce an output pulse having its preset width. However, if the interval between succeeding input trigger pulses is less than the preset value, the multivibrator will produce an output pulse of a continuous width until such time as the interval between the trigger pulses increases above the preset value to allow the multivibrator to stablilize.

The output of multivibrator 48 is connected to a discriminator network 54. The discriminator 54 includes a NAND gate 56 whose output is connected to the input of NAND gate 58 through resistor 60. A capacitor 62 is connected between the input of NAND gate 58 and a reference potential such as ground. The purpose of the discriminator 54 is to differentiate between the preset pulse width produced from multivibrator 48 and the wider continuous pulses therefrom. As will become apparent from reading the subsequent description, this insures that clutch coil 68 will not be activated by the preset width pulses which are produced when the carriage is returning at a safe speed. The value of capacitor 62 is chosen so that the preset width pulses from multivibrator 48 will not charge up capacitor 62 to the voltage required to turn on NAND gate 58. However, the capacitor value is chosen so that pulses having a width greater than the preset width pulses will be sufficient to charge up the capacitor 62 to the switching threshold level of the discriminator to produce an output signal from NAND gate 58. Accordingly, the time required to charge up capacitor 62 in order to turn on NAND gate 58 should be larger than the preset value of multivibrator 48.

The output of NAND gate 58 is connected to NAND gate 64 which serves to invert the input pulse in order to activate driver 66. Driver 66 can be of any of well known power amplifiers. For example, driver 66 can be a Darlington-type power amplifier providing an output current of approximately 10 amperes. The output of driver 66 is serially connected to the coil 68 of clutch 30. A protective diode 70 is coupled in parallel across coil 68 to prevent coil turn-off voltage transients from entering the digital control circuit and the driver 66.

Figure 4:
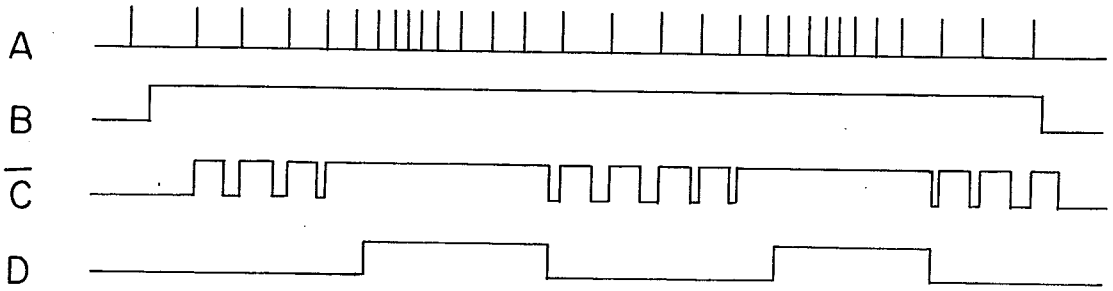
FIG. 4 is a pulse-timing diagram of the circuit shown in FIG. 3.

In operation, once carriage 12 has been released for its return to the home position, carriage return command pulse produces a high output state as shown in B of FIG. 4. As the spring 18 begins to pull carriage 12 towards the home position, the speed thereof progressively increases. Accordingly, the interval of the sync pulses produced by carriage speed pulse transducer 38 similarly decreases as shown by A of FIG. 4. When there is a sync pulse and a command pulse present at the input of NAND gate 46, it triggers the one-shot multivibrator 48. As long as the interval between the sync pulses is greater than the preset value of the multivibrator, it will produce an output pulse only equal to its preset width. These uniform preset width pulses are shown in the beginning of the pulse-timing diagram for $\overline{C}$ of FIG. 4.

However, once the carriage exceeds its safe speed, the interval between succeeding sync pulses becomes less than the preset value of the multivibrator. In such manner, the interval between the sync pulses signals that the carriage has exceeded a desired speed which is deemed to be the maximum velocity permitted for efficient, yet undestructive operation. Consequently, the multivibrator 48 produces a continuous output pulse in response to the decrease of interval between the sync pulses. Discriminator 54 in turn produces a continuous pulse or output signal as long as the pulse from multivibrator 48 stays on for more than the time required to charge up capacitor 62. Accordingly, discriminator 54 will not produce an output signal until the speed of the carriage exceeds its safe speed. The output signal produced by discriminator 54 is inverted and shown at D in FIG. 4. This pulse is then amplified by driver 66 and the current therefrom is used to energize coil 68 of clutch 30. The energization of coil 68 causes clutch 30 to engage driver disk 28 thereby acting as a brake.

This braking action causes carriage 12 to slow down to a safe speed. Consequently, the intervals between the sync pulses is increased above the preset value of multivibrator 48. Therefore, it produces only pulses of its preset width and does not produce a continuous output pulse as before. Accordingly, discriminator capacitor 62 does not charge up to the voltage needed to turn on NAND gate 58. Therefore, there is no output from NAND gate 58 which may energize clutch coil 68.

When the spring 18 again causes the speed of the carriage 12 to increase above its safe speed, the interval of the sync pulses decreases below the preset value of the multivibrator 48 and clutch coil 68 is energized as above described. This cycle continues until the carriage 12 reaches its home position at which time command pulse 44 goes to zero thereby deactivating the circuit.

The above circuit was found to work very uniformly and effectively with a multivibrator preset value of 0.8 milliseconds and wherein the pulse width required to produce an output from the discriminator was approximately 1 millisecond. It should be understood that the digital circuit of this invention can be adapted to control the return speed of a variety of number of carriages or printing devices. The preset value of the multivibrator and the discriminator switching time can be readily changed merely by varying variable resistor 52 and the value of capacitor 62, respectively. From the foregoing description it can now be realized that the circuit of this invention can be readily incorporated into a number of business machines without substantial expense. Furthermore, it provides an extremely fast response output that is necessary to effectively reduce noise, vibration, and possible breakage of business machine apparatus. Moreover, this invention permits the use of spring biased return carriages for business machines without any of the disadvantages heretofore encountered.

Therefore, while this invention was described in connection with a specific embodiment thereof, no limitation is intended thereby except as defined in the appended claims.

What is claimed is:

1. A digital circuit for selectively activating a clutch mechanism for limiting the return speed of a business machine carriage having a spring biased carriage return mechanism, said circuit comprising:

means for producing a continuous output pulse in response to input sync pulses indicating the return speed of the carriage along its return path, the pulses having intervals therebetween, the intervals signalling that the return speed of the carriage has exceeded a predetermined maximum speed; and means for coupling said continuous output pulse producing means to the clutch mechanism, said clutch being activated by the continuous output pulse to thereby limit the return speed of the carriage to the predetermined maximum speed.

2. The circuit of claim 1 wherein said continuous output pulse producing means includes a one-shot multivibrator having a preset pulse width, said multivibrator producing a continuous output pulse when the interval between succeeding input sync pulses is less than the preset pulse width.

3. The circuit of claim 2 which further includes discriminator means for producing an output signal only when pulses from the multivibrator have a width exceeding the present pulse width.

4. In a business machine having a carriage, spring biased means for returning the carriage to its home position, and a clutch mechanism for limiting the return speed of the carriage along its return path to a predetermined maximum speed, wherein the improvement comprises:

transducer means for producing a series of sync pulses with the interval between succeeding pulses being a function of the return speed of the carriage;

circuit means connected to said transducer means for producing a continuous output pulse when the interval between said sync pulses is less than a preset interval to thereby signal that the return speed of the carriage has exceeded the predetermined maximum speed; and means for selectively activating the clutch mechanism, said means being connected to said circuit means and being activated by the continuous output pulse therefrom thereby reducing the return speed of said carriage to the predetermined maximum speed in response to said continuous pulse.

5. The improvement of claim 4 wherein the transducer means includes a light source and a photoelectric device, both being attached to the carriage and having a stationary grid disposed therebetween.

6. In a business machine having a carriage, means for returning the carriage to its home position, and a clutch mechanism for controlling the return speed of the carriage, wherein the improvement comprises;

transducer means for producing a series of sync pulses with the interval between succeeding pulses being a function of the return speed of the carriage;

a one-shot multivibrator being connected to said transducer means, said multivibrator producing output pulses in response to the input sync pulses, said output pulses being of a preset width when the interval between the sync pulses is greater than the multivibrator preset pulse width and being of a continuous width when the interval between the sync pulses is less than the preset pulse width;

discriminator means being connected to said multivibrator, said discriminator means producing an output signal only when the output pulse from the multivibrator has a width exceeding said preset pulse width;

means for amplifying the output signal from said discriminator means; and means responsive to said amplified discriminator output signal for selectively activating the clutch, wherein the clutch is activated to reduce the return speed of the carriage in response to said discriminator output signal.

7. The improvement of claim 6 wherein the transducer means includes a light source and a photoelectric device, both being attached to the carriage and having a stationary grid disposed therebetween.

8. The improvement of claim 6 wherein the discriminator means includes:

a first logical gate having an input and an output, a second logical gate having an input and an output, and a capacitor, the output of said first logical gate being connected to the input of the second logical gate, the capacitor being coupled between the input of said second gate and a reference potential wherein the capacitor requires a charge time in excess of the preset pulse width from the multivibrator in order to turn on the second gate to produce an output signal therefrom.

9. In a business machine having a carriage, spring-biased carriage return means for returning the carriage to its home position, and an electromagnetic clutch for controlling the return speed of the carriage, wherein the improvement comprises:

a light emitting diode and a phototransistor attached underneath the carriage and being freely movable therewith, a stationary grid disposed between the diode and phototransistor wherein said phototransistor produces a series of sync pulses with intervals between succeeding pulses being a function of the speed of the carriage as it moves along said grid;

means for producing a command pulse signalling the return of the carriage to its home position;

a logical gate having an input and an output, the sync pulses and the command pulse being coupled to the logical gate input, the logical gate providing trigger pulses in response to a sync pulse and a command pulse;

a one-shot multivibrator with an imput and an output, the output of said logical gate being connected to the multivibrator input, the multivibrator producing output pulses in response to trigger pulses from the logical gate output, the multivibrator output pulses being of a preset width when the interval between succeeding trigger pulses is greater than the preset pulse width and being of a continuous width when the interval between succeeding trigger pulses is less than the preset pulse width;

means for discriminating between the multivibrator preset width pulses and the continuous width pulse, said discriminating means being connected to the output of said multivibrator and producing an output signal only when the width of the multivibrator pulse is greater than the preset width pulse;

means for amplifying the output signal from the discriminator; and a coil for energizing the electromagnetic clutch, said coil being connected to said amplified discriminator output signal whereby said coil energizes the clutch to reduce the return speed of the carriage in response to said output signal.

10. The improvement of claim 9 wherein the discriminator means includes:

a first logical gate having an input and an output, a second logical gate having an input and an output and a capacitor, the output of said first logical gate being connected to the input of the second logical gate, the capacitor being coupled between the input of the second gate and reference potential wherein the capacitor requires a charge time in excess of the preset width multivibrator pulse in order to turn on the second gate to produce an output signal therefrom.

* * * * *